US007848533B2

(12) United States Patent
Cobb

(10) Patent No.: US 7,848,533 B2
(45) Date of Patent: Dec. 7, 2010

(54) LOUDSPEAKER

(76) Inventor: Jason Myles Cobb, 6200 N. Golder St., Odessa, TX (US) 79764

( * ) Notice: Subject to any disclaimer, the term of this patent is extended or adjusted under 35 U.S.C. 154(b) by 1059 days.

(21) Appl. No.: 11/595,850

(22) Filed: Nov. 13, 2006

(65) Prior Publication Data

US 2008/0112587 A1 May 15, 2008

(51) Int. Cl.
*H04R 25/00* (2006.01)
*G10K 13/00* (2006.01)
*H04R 31/00* (2006.01)

(52) U.S. Cl. ..... 381/186; 181/163; 29/594

(58) Field of Classification Search ..... 381/150, 381/182, 185, 186, 342, 396, 397, 404, 419, 381/420, 423, 424, 432; 181/163, 171, 172; 29/594, 609

See application file for complete search history.

(56) References Cited

U.S. PATENT DOCUMENTS 1,844,787 A * 2/1932 Newill ..... 381/432
2,269,284 A 1/1942 Olson
2,496,589 A * 2/1950 Marquis ..... 381/186
3,213,209 A * 10/1965 Doelitzsch ..... 381/186
5,594,804 A 1/1997 Kim
6,212,284 B1 * 4/2001 Puls ..... 381/345
6,466,676 B2 * 10/2002 Coffin ..... 381/186

FOREIGN PATENT DOCUMENTS

JP 57190496 11/1982
JP 59149497 8/1984

* cited by examiner

*Primary Examiner*—Brian Ensey
*Assistant Examiner*—Sunita Joshi
(74) *Attorney, Agent, or Firm*—Stephen R. Greiner

(57) ABSTRACT

A loudspeaker includes a frame and a toroidal magnet that is affixed to the rear of the frame. The toroidal magnet has a central passageway that opens into the frame. A cap is affixed to the rear of the magnet and closes the central passageway. A guide rod is affixed to the cap and projects forwardly from the cap into the central passageway. A tubular former is slidably positioned upon the guide rod. A voice coil is wound about, and is affixed to, the tubular former. A forward cone has a narrow, rear end that is affixed to the tubular former and a wide, front end that is affixed to the front of the frame. A rearward cone has a narrow, forward end with a central opening that loosely receives the rear end of the forward cone. The rearward cone also has a wide, rearward end that is affixed to the frame rearwardly of the front end of the forward cone. A forward spider is affixed to the forward end of the rearward cone and is affixed to the rear of the frame. A rearward spider is affixed to the rear end of the forward cone and is affixed to the rearward end of the rearward cone.

1 Claim, 1 Drawing Sheet

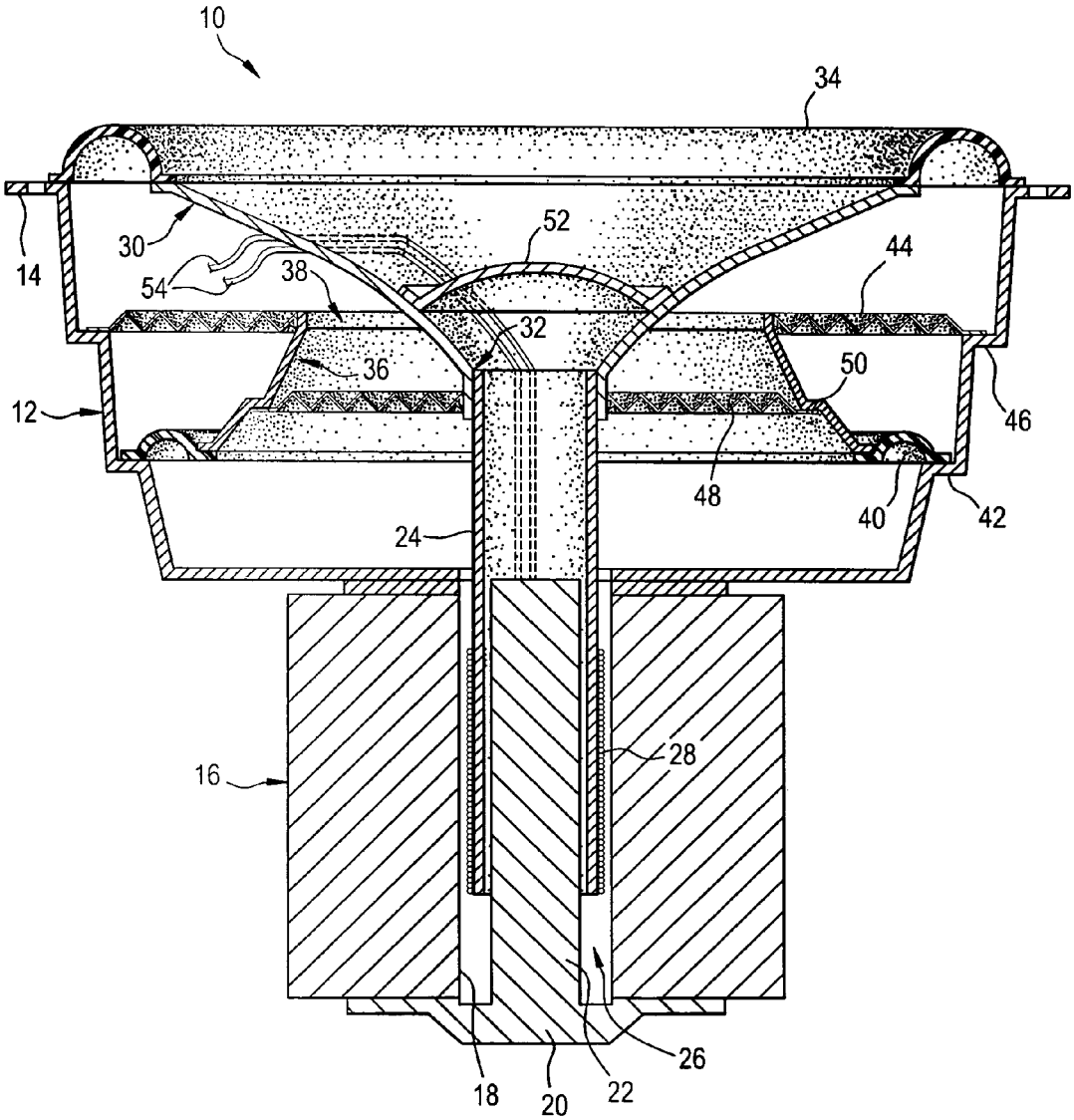
10
34
14
30
52
44
54
38
32
36
50
12
46
48
40
42
24
28
16
26
18
20
22

LOUDSPEAKER

FIELD OF THE INVENTION

The present invention relates generally to electrical audio signal processing systems and devices and, more particularly, to electro-acoustic audio transducers having plural diaphragms.

BACKGROUND OF THE INVENTION

A conventional loudspeaker includes a diaphragm or cone that is vibrated to move air in a piston-like manner and generate audible sounds. Typically, a radially corrugated device called a "spider" is secured to the cone to maintain the cone's position before, during, and after, sound-producing vibrations are induced. A spider permits the cone to move forwardly and rearwardly from its resting position with the full range of motion being known as "peak-to-peak excursion." As the peak-to-peak excursion of a loudspeaker cone increases, so does its ability to produce louder sounds, especially at lower frequencies.

Peak-to-peak excursion of a loudspeaker cone is often enlarged by increasing the diameter of the spider attached to the cone and by increasing cone diameter. Unfortunately, the small cabinets or other enclosures that are often expected to contain a loudspeaker place limits on the sizes of cones and spiders that can be used. Thus, the sound produced by many loudspeakers is less than satisfactory in terms of its quality and volume.

SUMMARY OF THE INVENTION

In light of the problems associated with the known loudspeakers, it is a principal object of the invention to provide a loudspeaker that features a pair of cones, with one positioned in front of the other, and a pair of supporting spiders that, together, maximize the peak-to-peak excursion of the forward cone without increasing either: 1) cone/spider diameters or 2) loudspeaker power requirements. Also, the rearward cone drives air like the forward cone, effectively increasing loudspeaker output. Thus, loudspeaker sound volume limits can be increased at minimal cost in space-restricted situations.

Another object of the invention is to provide a loudspeaker of compact size that can exceed the output, in terms of volume, frequency range, and quality, of a substantially larger loudspeaker of conventional construction.

It is an object of the invention to provide improved features and arrangements thereof in a loudspeaker for the purposes described that is lightweight in construction, inexpensive to manufacture, and dependable in use.

The foregoing and other objects, features, and advantages of the present loudspeaker will become readily apparent upon further review of the following detailed description of the preferred embodiment as illustrated in the accompanying drawing.

BRIEF DESCRIPTION OF THE DRAWING

The present invention is more readily described with reference to the accompanying drawing that is a vertical, cross-sectional view of a loudspeaker in accordance with the present invention.

DETAILED DESCRIPTION OF THE PREFERRED EMBODIMENT

Referring now to the drawing, a loudspeaker in accordance with the present invention is shown at 10. Loudspeaker 10 includes a conical frame 12 having an outwardly extending, peripheral, mounting flange 14 at its wide, front end and, also, having a narrow, rear end to which is affixed a toroidal magnet 16 with a central passageway 18 that opens into frame 12. A cap 20 is affixed to the rear end of magnet 16 that closes passageway 18. A guide rod 22, integrally formed with cap 20, projects forwardly from cap 20 and through passageway 18. A tubular former 24 is slidably positioned upon rod 22 in the annular space 26 located in passageway 18 between rod 22 and magnet 16. A voice coil 28 is wound about, and is affixed to, former 24 yet is spaced away from magnet 26. The narrow, rear end of a forward cone 30 is affixed to former 28 and is provided with a central opening 32 that snugly receives the front end of former 28. The wide, front end of forward cone 30, however, is affixed, by means of a resilient, ring-shaped, forward surround 34, to flange 14. A rearward cone 36 has a central opening 38 at its narrow, forward end that loosely receives the rear end of forward cone 30. The wide, rearward end of rearward cone 36 is affixed by a resilient, ring-shaped, rearward surround 40 to a peripheral rim 42 in frame 12 approximately midway between the front and rear ends of frame 12. A forward spider 44 encircles the forward end of rearward cone 36 and is affixed to a forward, peripheral rim 46 in frame 12 located between flange 14 and rim 42. A rearward spider 48 encircles the rear end of forward cone 30 and is affixed to the rear end of forward cone 30 and to a peripheral lip 50 at the rear end of rearward cone 36. A dust cover 52 is affixed within forward cone 30. A pair of electrical leads 54, for energizing voice coil 28, extends upwardly -from voice coil 28 and outwardly from forward cone 30, rearward of cover 52.

In use, cyclic energization of voice coil 28 causes former 24 to vibrate longitudinally at predetermined frequencies. Cones 30 and 36, being matched in terms of their sound production characteristics, respond simultaneously to the frequencies at which former 24 vibrates. The result is the production of tones (particularly those having a low frequency) of high volume from a loudspeaker 10 of small size.

While loudspeaker 10 has been described with a high degree of particularity, it will be appreciated by those skilled in the art that modifications can be made to it. Therefore, it is to be understood that the present invention is not limited to the sole embodiment of a loudspeaker described above, but encompasses any and all embodiments within the scope of the following claims.

I claim:

1. A loudspeaker, comprising:

a frame;

a toroidal magnet being affixed to the rear of the frame, the toroidal magnet having a central passageway that opens into the frame;

a cap being affixed to the rear of the magnet and closing the central passageway;

a guide rod being affixed to the cap and projecting forwardly from the cap into the central passageway;

a tubular former being slidably positioned upon the guide rod;

a voice coil being wound about, and being affixed to, the tubular former;

a forward cone having a narrow, rear end and a wide, front end, the rear end being affixed to the tubular former, the front end being affixed to the front of the frame;

a rearward cone having a wide, rearward end and a narrow, forward end, the forward end having a central opening that loosely receives the rear end of the forward cone, the forward end also being affixed to the frame rearwardly of the front end of the forward cone;

a forward spider being affixed to the forward end of the rearward cone and being affixed to the rear of the frame; and, a rearward spider being affixed to the rear end of the forward cone and being affixed to the rearward end of the rearward cone.

* * * * *